US005461845A

United States Patent [19]

Yeager

[11] Patent Number: 5,461,845

[45] Date of Patent: Oct. 31, 1995

[54] ZIPPERED FILM AND BAG

[76] Inventor: James W. Yeager, 1209 Robb St., Rte. 1, Box 7, Summit, Miss. 39666

[21] Appl. No.: 275,281

[22] Filed: Jul. 12, 1994

Related U.S. Application Data

[63] Continuation of Ser. No. 966,427, Oct. 26, 1992, abandoned.

[51] Int. Cl.[6] ..... B65D 33/24; B65D 33/28; B65B 9/06

[52] U.S. Cl. ..... 53/451; 383/63; 383/66; 383/203; 383/206

[58] Field of Search ..... 383/63, 66, 203–206; 53/451

[56] References Cited

U.S. PATENT DOCUMENTS

| | | | |
|---|---|---|---|
| 2,913,030 | 11/1959 | Fisher | 383/66 |
| 3,181,583 | 5/1965 | Lingenfelter | 383/66 |
| 3,426,959 | 2/1969 | Lemelson | 383/66 |
| 3,473,589 | 10/1969 | Gotz | 150/3 |
| 3,625,270 | 12/1971 | Skendzic | 383/63 |
| 4,241,865 | 12/1980 | Ferrel | 229/62 |
| 4,335,817 | 6/1982 | Bahr | 383/66 |
| 4,617,683 | 10/1986 | Christoff | 383/63 |
| 4,782,951 | 11/1988 | Griesbach et al. | 206/484 |
| 4,894,975 | 1/1990 | Ausnit | 53/412 |
| 4,909,017 | 3/1990 | McMahon et al. | 53/481 |
| 4,993,844 | 2/1991 | Robinson et al. | 383/63 |
| 5,022,530 | 6/1991 | Zieke | 206/618 |
| 5,024,537 | 6/1991 | Tilman | 383/63 |
| 5,036,643 | 8/1991 | Bodolay | 53/128.1 |
| 5,050,736 | 9/1991 | Griesbach | 206/484 |
| 5,116,140 | 5/1992 | Hirashima | 383/66 |
| 5,167,608 | 12/1992 | Steftens, Jr. et al. | 383/66 |
| 5,186,543 | 2/1993 | Corhran | 383/63 |

FOREIGN PATENT DOCUMENTS

| | | | |
|---|---|---|---|
| 0485741 | 10/1991 | European Pat. Off. | 383/66 |
| 675235 | 9/1990 | Switzerland | 383/66 |
| 998967 | 7/1965 | United Kingdom | 383/66 |

*Primary Examiner*—Stephen P. Garbe
*Attorney, Agent, or Firm*—David L. Ray

[57] ABSTRACT

A reclosable bag and plastic film and method for making the bag. The bag has a reclosable fastener connected to a single wall of the bag, and the film has a reclosable fastener connected to one side thereof which does not require attachment to any other portion of the film when making a bag. The fastener has a tamper-proof member attached thereto to indicate if the bag has been previously opened. The method includes providing a roll of film with attached fasteners, unwinding the film, forming it into a tube, and sealing the tube to form a bag.

5 Claims, 2 Drawing Sheets

ZIPPERED FILM AND BAG

This is a continuation of application Ser. No. 07/966,427, filed Oct. 26, 1992 now abandoned.

BACKGROUND OF THE INVENTION

1. Field of the Invention

The invention relates to plastic film having a reclosable fastener thereon and bags made from the film. Even more particularly, the present invention is related to plastic film having a reclosable fastener thereon which may be used in a form, fill, and seal packaging machine to package items in a reclosable bag.

2. Description of the Related Art

Plastic bags are well known in the art. Such bags may be used for containing a variety of items. A popular use for plastic bags is to contain and display food items such as poultry and the like. Exemplary of the prior art are the following patents:

U.S. Pat. No. 5,116,140 discloses an easy-to-open synthetic resin bag including (a) a bag body substantially composed of a pair of laminated walls made of synthetic resin films, the peripheries of the laminated walls being heat-sealed to form a sealed border region while defining an unsealed storing space within the sealed border region, (b) a tear string which is heat sealed along an imaginary opening line on the inside of one of the laminated walls, the tear string having both ends thereof heat sealed in a sandwiched condition on the corresponding portion of the sealed border region, (c) a pulling tab formed by cutting a part of one side portion of the sealed border region which corresponds to one end of the tear string, the pulling tab being tearable from the bag body integrally with the tear string, and (d) a tear string retaining portion including a transverse opening which is formed by cutting off a part of the other side portion of the sealed border region and a pair of inside and outside heat sealed portions which are located at both sides of the transverse opening, the transverse opening extending in a direction perpendicular to the tear string such that the tear string passes through a central portion of the transverse opening. Due to such a tear string retaining portion, the separation and complete removal of the tear string from the bag is reliably prevented while assuring the easy bag opening operation.

U.S. Pat. No. 5,050,736 discloses a reclosable package including interlocking closure strips positioned outside of a hermetic seal or seal area and the method for producing same. The hermetic seal is of the easy-open or peelaway type so as to not destroy the integrity of the package or closure strips upon opening of the package.

U.S Pat. No. 5,036,643 discloses a form, fill, seal and separate packaging machine for reclosable containers to web by a plurality of stations disposed along a path of travel of a thermoplastic web including a device to attach a pair of mated, resealable closure strips to the base web. The machine is intermittent in its operation, with movement of the web through the machine controlled so that the various steps of applying the closure strips, forming, filling, sealing and separating the reclosable containers are performed during periodic stops of the machine. The machine is further characterized by its use of two pairs of web belts to move the web through the machine. A first pair of web belts initially receive the folded web stock and partially form and completely fill the containers. The second pair of web belts overlap with the downstream end of the first pair of belts, but are disposed lower than the first belts. When the filled partially formed containers pass from the first pair of belts to the second pair of belts, the unsealed free ends are exposed for final sealing and severing.

U.S. Pat. No. 5,022,530 discloses a modified zipper elements for easy open containers having interlocking zipper elements and a tear strip for opening the container along the upper edge, wherein the bases of the zipper elements are extended upward towards the tear strip to limit the area of tearing and protect the zipper elements, and a method for making.

U.S. Pat. No. 4,909,017 discloses a reclosable bag material, method and apparatus which is a new method of making a form fill bag having a reclosable fastener thereon and a mechanism therefor wherein a continuous length of film is advanced and .joined first and second fastener profile strips are laid laterally onto the film of a length substantially equal to one-half of the film width, the film is advanced and formed into a tube with the side edges folded together and seamed, the first profile strip is attached to the surface of the film prior to forming it into the tube and the second opposed interlocked profile strip is attached to the inner surface of the film after it is formed into a tube, and a cross-seam is formed in the tube above the closure strip to form the bottom of the succeeding bag, and a completed bag is cut from the film by cutting below the bottom seam and above the fastener strips.

U.S. Pat. No. 4,894,975 discloses a method and apparatus for making reclosable bags with fastener strips in a form fill and seal machine from a supply of thin thermoplastic film with the film being formed into tubular shape about a filling tube with the edges of the film brought together and joined solely by a zipper strip having reclosable pressure interlocking members thereon with the zipper strip preferably heat sealed to the film and the zipper strip having a web between the pressure interlocking members which provides a tamper-evident juncture between the edges of the film so that the web must be severed for access to the interior of a bag formed from the film, and individual bags formed from the continuous tube by filing the tube through the filling tube and cross-seaming and cutting individual bags from the continuous film tube.

U.S. Pat. No. 4,782,951 discloses a reclosable package and method of making reclosable package including interlocking closure strips positioned outside of a hermetic seal or seal area and the method for producing same. The hermetic seal is of the easy-open or peelaway type so as to not destroy the integrity of the package or closure strips upon opening of the package.

U.S. Pat. No. 4,617,683 discloses a reclosable bag, material, and method of and a device for making same wherein in one aspect extruded resiliently flexible plastic profiled reclosable fastener strip device for reclosable bags is located across the longitudinal formation axis of the bag wall web material, and in another aspect of the invention single strip fastener strip has at one or more suitable locations therealong separations across the profiles, such as notches, to facilitate bending or folding of the strip upon itself so that the self-interlocking profiles of the portions of the strip folded upon themselves are adapted for reclosable interlocking with one another. The interlockable portions of the strip may have separable air tight sealing ribs therealong. The web and fastener material and fastener assembly is especially suitable for machines wherein the bags are formed, filled and sealed.

U.S. Pat. No. 4,241,865 discloses a reclosable shipping sack and method, the sack having a pouring mouth from which discrete pourable contents may be discharged, including a primary non-reclosable stitched closure fastener across and closing the mouth against unintentional discharge of the contents and including a device such as chain stitch and rip strip for facilitating digital opening of the primary closure fastener. A secondary, reclosable fastener, desirably of the zipper type, extends across the sack mouth outwardly from the primary closure fastener and is adapted for selectively opening and closing the sack mouth after opening of the primary closure fastener. A method of making the reclosable sack is also disclosed.

U.S. Pat. No. 3,473,589 discloses a plastic bag having a closure structure and a method for making same, the structure having a first thin inner layer of flexible plastic material with a first fastener element extending therealong formed of a resilient material and being of one piece with the layer, a second thin inner layer of flexible plastic material facing the first layer and having a uniform second fastener element extending therealong formed of a resilient material and being of one piece with the second layer and shaped to be releasably interlocked with the first fastener element, a first outer layer positioned over the outer surface of the first inner layer and laminated thereto, the first inner and outer layers providing a first substantially monolithic wall so that the first inner layer provides a support with the layers coacting and allowing a stronger lock with a thin film, and a second outer layer positioned over the outer surface of the second inner layer and laminated thereto, the second inner and outer layers providing a second substantially monolithic wall so that the second inner layer provides a backing for the support allowing a stronger lock with a thin film, the outer layers laminated to the inner layer opposite fastener elements so as to reinforce the inner layers in the area of the fastener elements.

SUMMARY OF THE INVENTION

In accordance with the present invention there is provided a reclosable bag and plastic film for making the bag, and a method for making the bag. The bag has a reclosable fastener connected to a single wall of the bag, and the film has a reclosable fastener connected to one side thereof which does not require attachment to any other portion of the film when making a bag. The fastener has a tamper-proof member attached thereto to indicate if the bag has been previously opened.

The film of the invention has the advantage of having a reclosable fastener completely connected thereto prior to being fed to a form, fill, and seal machine, thereby eliminating the need to apply a reclosable fastener during the form, fill, and seal process and eliminating the need for the equipment necessary to add a reclosable fastener during the form, fill, and seal machine.

The film of the invention has the additional advantage of being capable of forming a reclosable bag on a vertical or horizontal form, fill, and seal machine.

The bag and film of the invention has the advantage of allowing the reclosable fastener to be located at any desired distance from the top or bottom of the bag because the fastener is attached to only one wall of the bag of the invention.

BRIEF DESCRIPTION OF THE PREFERRED EMBODIMENTS

Figure 1:
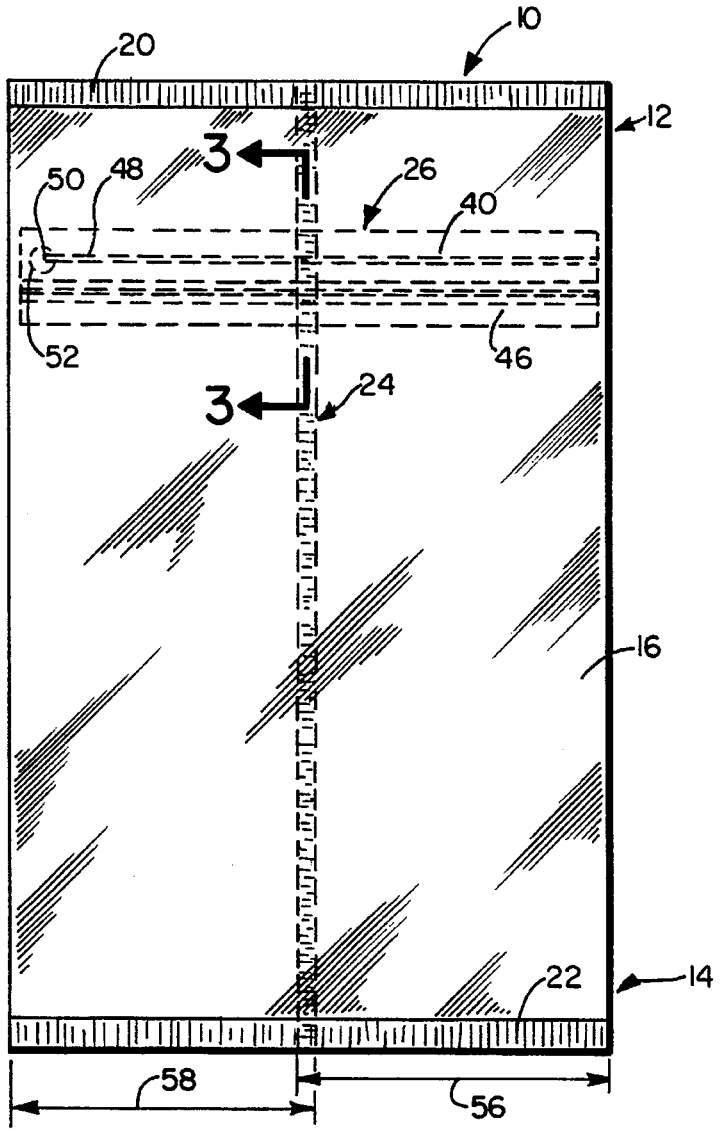
FIG. 1 is a front elevational view of the bag of the invention.
Figure 2:
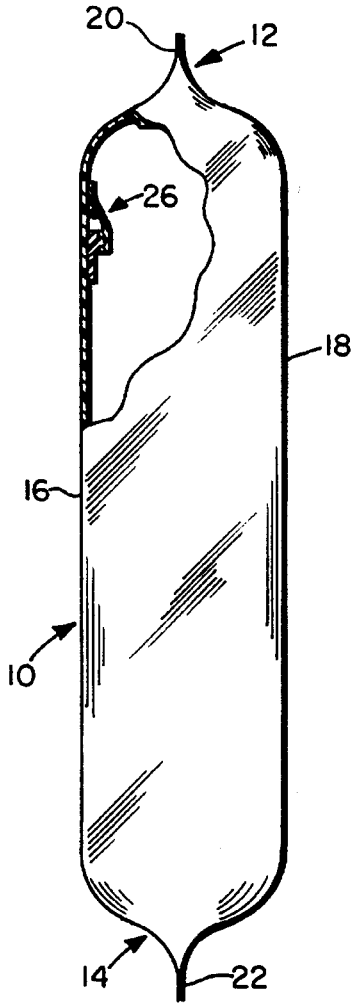
FIG. 2 is a partly cut-away, side elevational view of the bag shown in FIG. 1.
Figure 3:
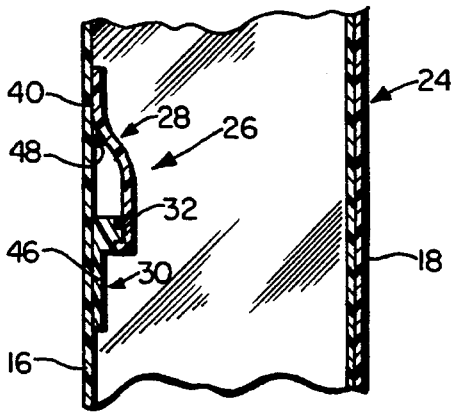
FIG. 3 is a cross-sectional view of the bag of FIG. 1 taken along lines 3—3 of FIG. 1.

Referring now to the drawings, in FIGS. 1 and 2 is shown the reclosable bag of the invention generally indicated by the numeral 10. Bag 10 has a top end generally indicated by the numeral 12 and a bottom end generally indicated by the numeral 14. Bag 10 has a front wall 16 and a back wall 18.

Bag 10 has a seal 20 at the top end 12 at which the front wall 16 is joined to the back wall 18, and a seal 22 at the bottom end at which the front wall 16 is joined to the bottom wall 18. Located on the back wall 18 is a seam generally indicated by the numeral 24.

Figure 5:
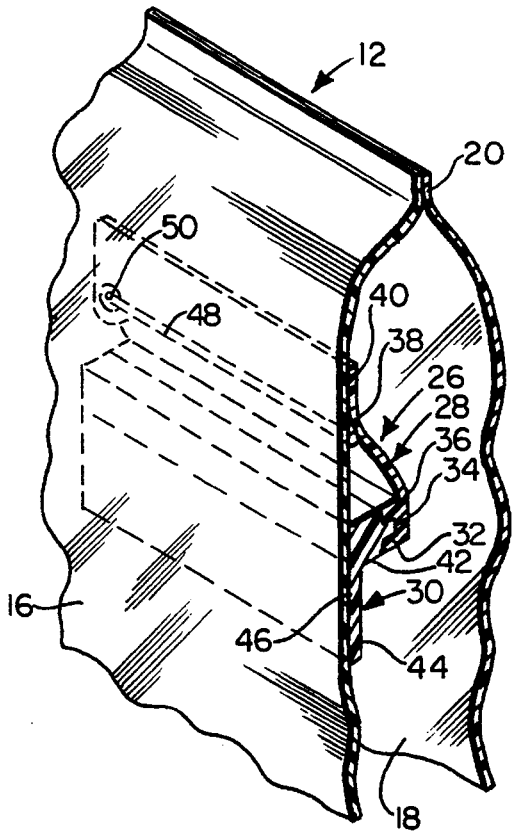
FIG. 5 is a partly cut-away, partly cross-sectional, detailed perspective view of the reclosable fastener connected to the bag of the invention.

As can best be seen in FIG. 5, connected to front wall 16 is a reclosable fastener assembly generally indicated by the numeral 26 having two opposite ends **26*a* and 26*b*. Reclosable fastener assembly 26 includes two profile strips generally indicated by the numerals 28 and 30 which are shown in the drawings to be interlocked. Profile strip 28 contains a groove 32 and profile strip 30 contains a protuberance 34 which is lockingly received in the groove 32**.

Each end **26*a* and 26*b* of reclosable fastener assembly 26 is preferably sealed in any conventional manner such as heat sealing to the inside of front wall 16 to prevent air or liquids from entering or leaving bag 10 through the ends 26*a* and 26*b* of reclosable fastener assembly 26 after the front wall 16 has been opened by the user of the bag 10 to gain access to reclosable fastener assembly 26. However, if desired, the ends 26*a* and 26*b* need not be sealed to the inside of front wall 16, and after opening front wall 16, and air or liquids can enter or leave bag 10 through the ends 26*a* and 26*b* of bag 10 and through the opening in front wall 16**.

The bag 10 is air tight prior to opening the front wall 16 to gain access to reclosable fastener assembly 26. Therefore, products can be vacuum packed in bag 10.

Groove 32 is formed in groove body 36, and groove body 36 is integrally connected to groove body arm 38. A portion of groove body arm 38 is connected to the inside of front wall 16 at seal 40. Groove body arm 38 could be made separately from groove body 36 and attached to groove body 36 in any conventional manner such as heat sealing.

Protuberance 34 is integrally connected to protuberance body 42, and protuberance body 42 is integrally connected to protuberance body leg 44. A portion of protuberance body leg 44 is connected to the inside of front wall 16 at seal 46. Protuberance body leg 44 could be made separately from protuberance body 42 and attached to protuberance body 42 in any conventional manner such as heat sealing.

A string 48 for tearing a portion of front wall 16 to expose and provide access to reclosable fastener 26 is located adjacent to the inside of front wall 16 and seal 40. String 48 has an exposed end 50 connected to pull tab 52 for grasping by the customer and pulling to tear a portion of the front wall 16 covering reclosable fastener 26. If desired, string 48 could be replaced with a plurality of perforations in front wall 16 between seal 40 and protuberance body 42. If desired, string 48 and the plurality of perforations in front wall 16 could be omitted from bag 10, and the portion of front wall 16 between seal 40 and protuberance body 42 could be opened with a sharp object such as knife or scissors.

Figure 4:
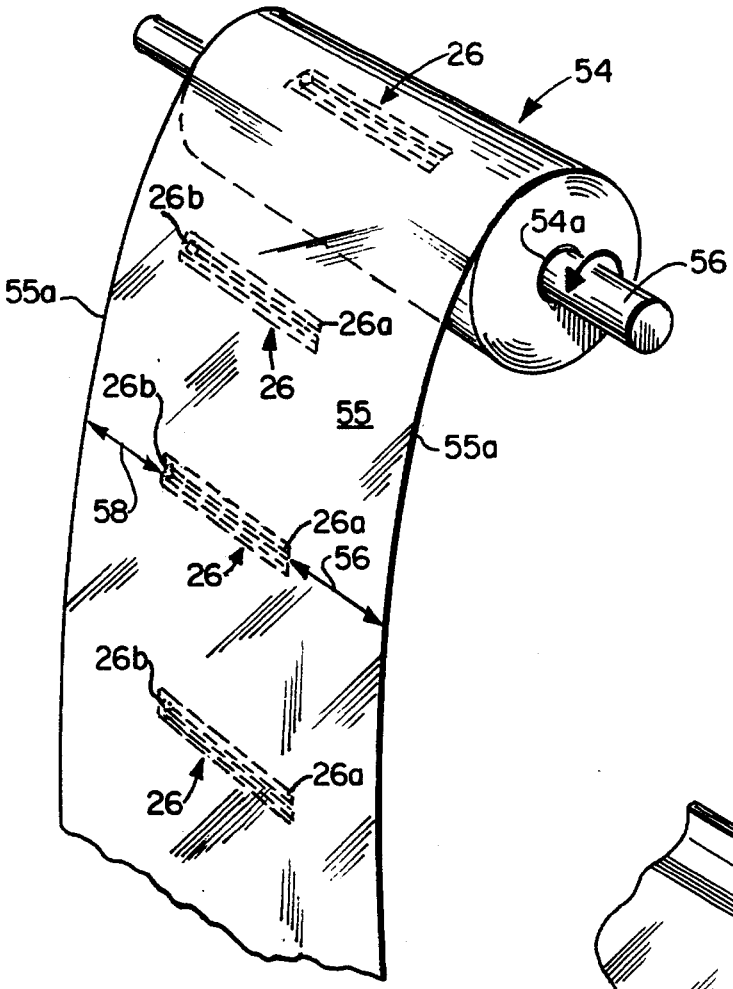
FIG. 4 is perspective view of a roll of film of the invention having a plurality of reclosable fasteners connected thereto.

A roll of film 54 on a paper core 54*a* placed on an axle or roller 56 containing the reclosable fastener 26 is shown in FIG. 4. Film roll 54 can be prepared by connecting reclosable fastener 26 to a flat sheet of film 55 at seal 40 and 46. String 48 of reclosable fastener 26 may be connected to reclosable fastener 26 prior to attaching reclosable fastener 26 to film 55. If desired, film 55 may be perforated to allow string 48 to extend therethrough. Also, as stated above, string 48 could be eliminated and replaced with a plurality of perforations on front wall 16 to permit access to reclosable fastener 26 by tearing along the plurality of perforations. If desired, reclosable fastener 26 could be attached to film 55 parallel to the edge 55*a* of film 55, i.e., rotated 90 degrees from the orientation shown in FIG. 4 where reclosable fastener is shown in the preferred orientation perpendicular to the parallel edges 55*a* of film 55.

To make the bag 10 of the invention from the roll of film 54, each side 56 and 58 of the film 54 is folded together as shown in FIG. 1 to overlap and form seal 24. The combined length of sides 56 and 58 must be greater than the length of reclosable fastener 26 to enable seal 24 to be formed. Top seal 20 and bottom seal 22 can then be made simultaneously or in any desired order. For example, bottom seal 22 could be made first, the bag could then be filled with a product such as a food item or the like, and then the top seal 20 could be made. The roll of film 54 could be used on a conventional form, fill, and seal machine. Such machines are well known in the art. U.S. Pat. No. 4,617,683 shows a typical form, fill, and seal operation with the exception that a reclosable fastener is added, and U.S. Pat. No. 4,617,683 is hereby incorporated by reference.

Any conventional bag making film known in the art may be utilized as the film stock to make bag 10. The seals of the invention are preferably made by heat sealing as is well known in the art. Such bag film is commonly referred to as plastic film, and is commonly made from polymeric materials.

Although the preferred embodiments of the invention have been described in detail above, it should be understood that the invention is in no sense limited thereby, and its scope is to be determined by that of the following claims:

What is claimed is:

1. A method for making reclosable bags comprising:

a. connecting a plurality of reclosable fasteners each with two interlocking profile strips to a rectangular sheet of film having two parallel side edges and a top and a bottom edge, said reclosable fasteners being less than half the width of said rectangular sheet of film and spaced a single bag length apart, said reclosable fasteners being perpendicular to said two side edges, each profile strip of each reclosable fastener being maintained in interlocked position and being independently connected to the same side of said film, said film being maintained in a flat unfolded state, b. winding said sheet of film in said flat unfolded state into a roll on a cylindrical core material, said reclosable fasteners being perpendicular to the direction said film is wound upon said core, c. unwinding said roll of film and overlapping said side edges of said film to form a tube to enclose said reclosable fasteners on the inside of said tube, said tube having a top edge and a bottom edge, d. sealing said overlapped side edges of said film, e. sealing said bottom edge of said tube, and f. sealing said tube said single bag length from said bottom edge to form a top edge of said bag to enclose a single reclosable fastener.

2. The method of claim 1 further comprising the securing of each end of said reclosable fastener strips to said film whereby air and liquids are prevented from entering or leaving through said ends when a bag is formed from said film and after front wall of said bag has been opened by user to gain access to said reclosable fastener.

3. A roll of film for making reclosable bags on form, fill, and seal machines, said film comprising:

a. a rectangular sheet of film having two parallel side edges and a top and a bottom edge, b. reclosable fastener assemblies each with two interlocking profile strips independently connected to one side of said film a single bag length apart, said reclosable fastener assemblies being perpendicular to said two side edges, said reclosable fastener assemblies being less than half the width of said rectangular sheet of film, c. each profile strip of each reclosable fastener being maintained in interlocked position and being independently connected to the same side of said film while said film is maintained in a flat unfolded state, and d. said film being wound into a roll while being maintained in said flat unfolded state whereby said side edges of each spiral of said roll are substantially aligned.

4. The film of claim 3 further comprising a continuous arm connected to at least one of said reclosable fastener strips along its full length, each end of said arm and said reclosable fastener strip being secured to said film whereby air and liquids are prevented from entering or leaving through said ends when a bag is formed from said film and after front wall of said bag has been opened by user to gain access to said reclosable fastener.

5. The film of claim 3 wherein said bottom edge is parallel to said top edge.

* * * * *